US005128721A

United States Patent [19]

Uematsu

[11] Patent Number: 5,128,721

[45] Date of Patent: Jul. 7, 1992

[54] LIQUID DEVELOPMENT APPARATUS FOR DEVELOPING A LATENT ELECTROSTATIC IMAGE

[75] Inventor: Ryosuke Uematsu, Tokyo, Japan

[73] Assignee: NEC Corporation, Tokyo, Japan

[21] Appl. No.: 309,761

[22] Filed: Feb. 13, 1989

[30] Foreign Application Priority Data

Feb. 12, 1988 [JP] Japan ..... 63-30317

[51] Int. Cl.[5] ..... G03G 15/10

[52] U.S. Cl. ..... 355/256; 118/659; 354/317

[58] Field of Search ..... 355/256; 354/317; 118/659, 660

[56] References Cited

U.S. PATENT DOCUMENTS

| | | | |
|---|---|---|---|
| 3,133,484 | 5/1964 | Wright | 355/256 X |
| 3,392,707 | 7/1968 | Marx | 118/659 |
| 3,460,456 | 8/1969 | Chen et al. | 355/317 |
| 3,576,623 | 4/1971 | Snelling | 355/256 X |
| 3,786,736 | 1/1974 | Neeb et al. | 355/317 |
| 3,827,906 | 8/1974 | Sato et al. | 355/256 X |
| 3,859,960 | 1/1975 | Lloyd | 118/660 |
| 4,198,923 | 4/1980 | Blumenthal | 355/317 X |
| 4,202,620 | 5/1980 | Klavan et al. | 355/256 |
| 4,545,326 | 10/1985 | Carl | 118/660 |
| 4,563,080 | 1/1986 | Ottley | 118/659 X |
| 4,623,241 | 11/1986 | Buchan et al. | 355/256 |

*Primary Examiner*—Fred L. Braun

*Attorney, Agent, or Firm*—Sughrue, Mion, Zinn, Macpeak & Seas

[57] ABSTRACT

A liquid development apparatus for developing a latent electrostatic image formed on a latent electrostatic image carrier into a visible image. The development apparatus includes a toner tank containing a liquid toner, a toner supplier member for supplying liquid toner to the latent electrostatic image carrier and a fluid resistant member for regulating the flow rate of the liquid toner towards the image carrier. The supplier member includes a toner passageway having an opening which is slightly spaced from the image carrier so as to form a gap therebetween. The fluid resistant member is provided close to the gap of the toner passageway such that the amount of supply toner is controlled.

9 Claims, 2 Drawing Sheets

LIQUID DEVELOPMENT APPARATUS FOR DEVELOPING A LATENT ELECTROSTATIC IMAGE

BACKGROUND OF THE INVENTION

The present invention relates to a development apparatus for an electrostatic image formation and, more particularly, to a development apparatus which uses a liquid developer.

A conventional apparatus for developing a latent electrostatic image on a photoconductive drum by means of a liquid toner has been proposed in U.S. Pat. No. 4,202,620. In the proposed apparatus, the liquid toner is located close to but out of contact with a latent image carrier, i.e., the photoconductive drum, so that the background where the latent image is not formed becomes less smudgy and less smeary. U.S. Pat. No. 4,202,620 disclosed a toner supplier device provided with a capillary passageway for supplying toner formed between two plates which are opposed to each other with a small clearance. When the device is submerged at one end thereof in a liquid toner, the liquid toner advances to the other end of the device due to capillarity to thereby form meniscus. The device is supported in such a manner that its longitudinal direction is parallel to the rotary shaft of the photoconductive drum, and that the meniscus is held close to, but out of contact with, the surface of the photoconductive drum.

When the latent electrostatic image formed on the photoconductive drum approaches the other end of the toner supplier device or the meniscus of the liquid toner with the movement of the photoconductive drum, a projection grows from a surface of the liquid toner toward the photoconductive drum to eventually come in contact and adhere only on the latent electrostatic image owing to electrostatic field. Since the device can use an aqueous toner as the liquid toner, undesirable organic vapor will not be generated from solvent when the liquid toner is dried.

However, the conventional development apparatus is not completely free of drawbacks as the liquid toner tends to be supplied in excess from the supplier device to the photoconductive drum. As the projection starts to form, the electrostatic field of the latent electrostatic image tends to concentrate on that portion. Therefore, if a plurality of fine picture elements of the latent image exist close to each other, only one projection which is initially formed grows to reach the latent image, rather than the plurality of projections being formed to correspond to respective picture elements of the image. As a result, a fine latent image cannot be developed clearly.

The above-mentioned development apparatus has a further shortcoming that, when the apparatus is inclined or applied with impact, the liquid toner tends to flow over from the other end of the supplier device filling in a gap between the photoconductive drum surface and the toner supplier device due to the surface tension of the liquid toner, to thereby incapacitate the proper development operation. Moreover, the liquid toner easily spills within the apparatus to contaminate it.

SUMMARY OF THE INVENTION

An object of the present invention is, therefore, to provide a liquid development apparatus capable of developing a latent electrostatic image accurately at a high developing density or with fine grains.

Another object of the present invention is to provide a liquid development apparatus which can prevent liquid toner from spilling out even if the development apparatus is inclined or is applied with an impact.

In order to attain the above-mentioned objects, the liquid development apparatus according to the present invention comprises: a toner tank for containing a liquid toner; a pair of plates members defining a supply passageway for the liquid toner which is fed with the liquid toner from the toner tank and provided with a toner supply opening which is opposed to a latent electrostatic image carrier without contacting the same; and a fluid resistant member provided in said supply passageway.

DESCRIPTION OF THE PREFERRED EMBODIMENT

Figure 1:
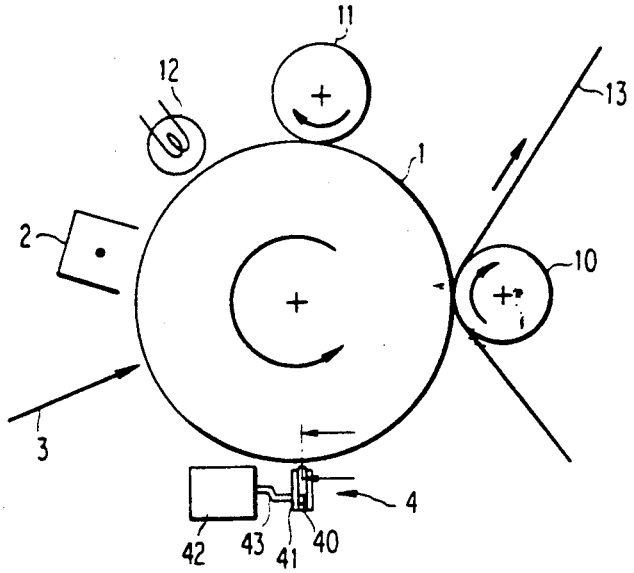
FIG. 1 is a structural view showing an electrophotographic apparatus using an embodiment of the present invention.

Referring to FIG. 1, an electrophotographic apparatus incorporating an embodiment of the present invention comprises a photoconductive drum 1, an electric charger 2, a liquid developer 4, a transfer roller 10, a cleaner 11 and an eraser 12. The electric charger 2 uniformly charges the surface of the drum 1 which rotates in a direction marked with an arrow. A latent electrostatic image are formed on the surface of the drum 1 by exposure light 3. The developer 4 develops the latent electrostatic image thus formed. More specifically, as the drum 1 moves, the latent electrostatic image approaches closer to meniscus of the liquid toner 40 formed in the liquid developer 4, and a projection grows from the surface of the liquid toner 40 toward the drum 1 due to the effect of the electrostatic field to eventually make the toner 40 adhere onto the latent image and develop the same. The developed image is subsequently transferred on a sheet of paper 13 which is passing between the drum 1 and the transfer roller 10. The residual liquid toner on the surface of the drum 1 is removed by the cleaner 11. Thereafter, the electrostatic image on the surface of the drum 1 is erased with the eraser 12.

The developer 4 comprises a liquid toner supplier device 41 opposed to the drum 1 with an extremely small gap of about 0.2 mm, a toner tank 42 which contains the liquid toner 40 and a tube 43 which supplies the liquid toner 40 from the tank 42 to the toner supplier device 41.

Figure 2:
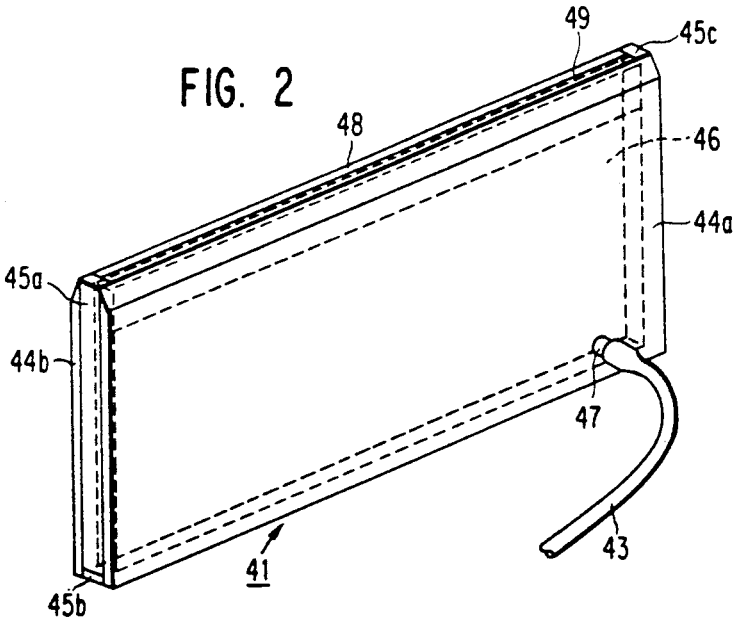
FIGS. 2 and 3 are a perspective view and a partially exploded perspective view, respectively, showing the embodiment of the invention.
Figure 3:
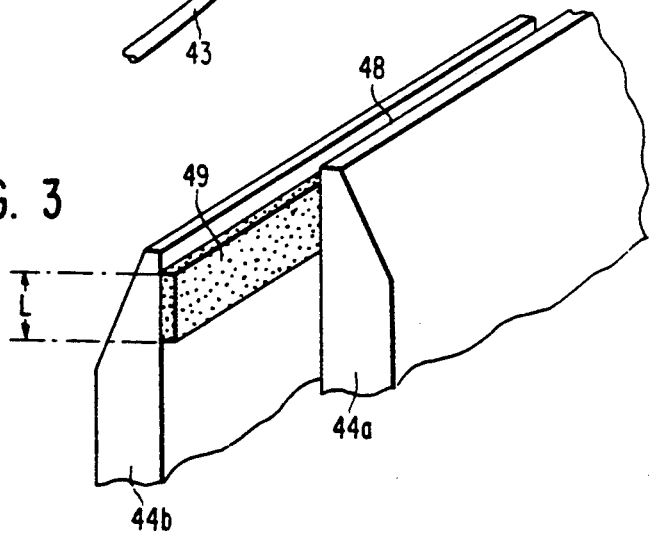

Referring now to FIGS. 2 and 3, the toner supplier device 41 comprises a pair of plates 44*a* and 44*b* which are opposed to each other at an interval of about 100 μm formed by spacers 45*a*, 45*b* and 45*c*. The spacers 45*a*, 45*b* and 45*c* and the plates 44*a* and 44*b* are made of polycarbonate and are attached to each other with adhesive. A toner passageway 46 is formed within the toner supplier device 41. The plate 44*a* is provided with an toner inlet 47 to guide the liquid toner 40 fed from the tube 43 through the toner passageway 46. The toner supplier device 41 has an opening 48 in the form of a slit on the upper side thereof, which opposes the surface of the photoconductive drum 1. The opening 48 is longitudinally in parallel to the rotational shaft of the drum 1.

A porous member 49 made of urethane foam or nonwoven fabric made of glass fiber is held between the plates 44*a* and 44*b* along the opening 48 close thereto. The pores in the porous member 49 are of open-cell type, and guide the liquid toner 40 in the passageway 46 into the opening 48 while regulating the toner amount. The size (mean diameter) of an open-cell foam is determined appropriately depending on the viscosity of the liquid toner 40 and the length L of the porous member 49. For example, if the viscosity is 2 cp and the length L is 1 mm, the mean diameter of a pore will be about 10 μm.

Description will now be given to the process of development by the developer 4 which has the structure mentioned above, referring to FIGS. 4*a* through 4*c*.

Figure 4A:
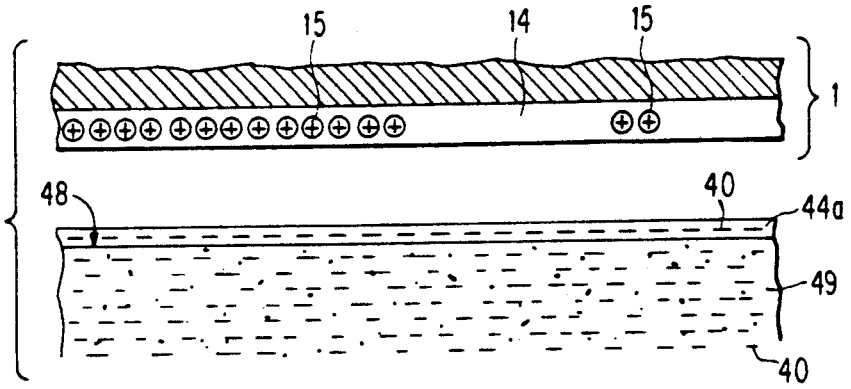
FIGS. 4*a* through 4*c* are cross sectional views taken along IV—IV line in FIG. 1 showing development process in the embodiment of the invention.
Figure 4B:
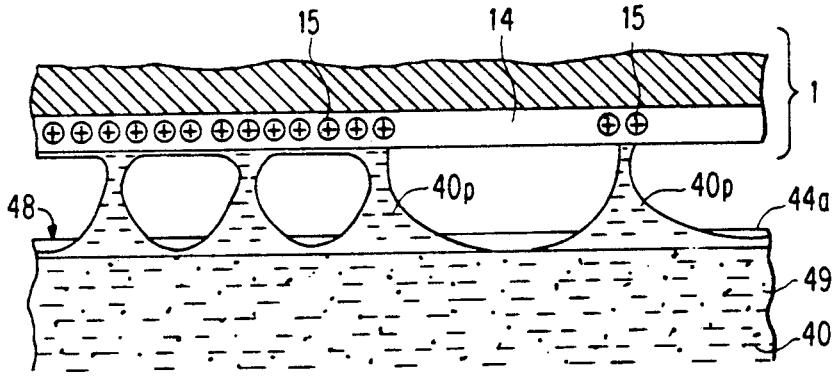
Figure 4C:
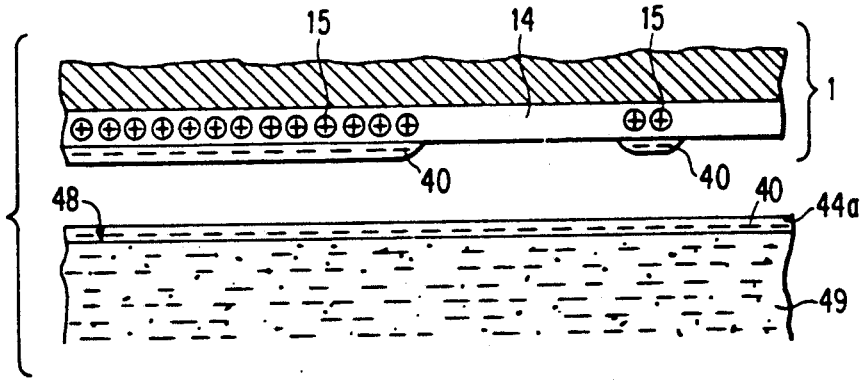

In FIGS. 4*a* through 4*c*, when the passageway 46 is filled with the liquid toner 40 and the head thereof is kept slightly positive pressure, a convex meniscus of the liquid toner 40 is formed at the opening 48 of the passageway 46 (FIG. 4*a*). Along with the movement of the drum 1, when picture elements 15 of the latent electrostatic image formed on a photoconductor layer 14 of the drum 1 approaches closer to the opening 48, the magnitude of the change in the electric field in the space therebetween increases, and the liquid toner starts to project from the meniscus surface toward the picture elements 15 to form a projection 40*p* which is attracted toward the latent electrostatic image. At this time, since the liquid toner 40 is attracted to the projection 40*p*, the toner shortage occurs temporarily around the projection 40*p* to thereby pull the meniscus back into the porous member 49 (FIG. 4*b*). This prevents the toner 40 from being supplied in excess to an extremely fine picture element 15 of the latent electrostatic image (right side), and secures development of clear images (FIG. 4*c*). When the toner in the meniscus runs out, the liquid toner 40 is supplied anew through the open cells of the porous member 49.

When the developer 4 is inclined or applied with an impact to apply sudden pressure on the toner 40 in the passageway 46 in the direction to push the same out of the opening 48, the toner 40 is prevented from being pushed out from the opening 48 and the meniscus is stably maintained because of large passage resistance of the porous member 49.

As is described in detail in the foregoing, owing to the higher passage resistance of the porous member in the opening of the toner supply passageway, the present invention secures precise and accurate development of minute picture elements of the latent electrostatic image. Further, it can prevent the liquid toner from spilling over from the supply passageway and filling the gap between the latent image carrier and the toner supplier which may otherwise incapacitate accurate development of the image even when the developer device is inclined or applied with an impact. Moreover, the present invention has an effect to prevent in advance such accidents as spilling over of the liquid toner in the electrostatic image formation apparatus to contaminate the same.

What is claimed is:

1. A development apparatus for developing a latent electrostatic image formed on a latent electrostatic image carrier into a visible image comprising:

a toner tank for containing a liquid toner;

a toner supplier member including a toner passageway for supplying said liquid toner to said image carrier, said toner passageway having an opening opposing said latent electrostatic image carrier and being slightly spaced therefrom so as to form a gap therebetween;

means for supplying said liquid toner from said toner tank to said toner supplier member; and a fluid resistant member provided in said toner passageway at a position close to said opening of said toner passageway for limiting the flow rate of said liquid toner in the direction toward said latent electrostatic image carrier, said fluid resistant member maintaining a convex meniscus formed of said liquid toner at said opening slightly spaced from said latent electrostatic image carrier in the absence of a latent electrostatic image opposing said opening, so that said liquid toner projects from said convex meniscus only to said latent electrostatic image formed on said latent electrostatic image carrier.

2. The development apparatus as claimed in claim 1, wherein said fluid resistant member is a porous member with open-cell foam.

3. The development apparatus as claimed in claim 1, wherein said toner supplier member comprises a pair of opposing plates and spacers held between said pair of plates so as to form said toner passageway.

4. The development apparatus as claimed in claim 3, wherein said plates and spacers are made of polycarbonate.

5. The development apparatus as claimed in claim 3, wherein said plates are spaced apart by a distance of approximately 100 mm.

6. The development apparatus as claimed in claim 1, wherein said supplier means comprises a tube.

7. The development apparatus as claimed in claim 1, wherein said gap is approximately 0.2 mm.

8. The development apparatus as claimed in claim 1, wherein said opening is in the form of a slit disposed on the upper side of said toner supplier member.

9. An electrostatic image forming apparatus comprising:

a latent electrostatic image carrier;

means for forming a latent electrostatic image on said latent electrostatic image carrier;

development means for developing said latent electrostatic image with a liquid toner, said development means including a toner tank for containing said liquid toner, a toner supplier member including a toner passageway for supplying said liquid toner to said image carrier, said toner passageway having an opening opposing said latent electrostatic image carrier and being slightly spaced therefrom so as to form a gap therebetween, means for supplying said liquid toner from said toner tank to said toner supplier member, and a fluid resistant member provided in said toner passageway at a position close to said opening of said toner passageway for controlling the formation of a convex meniscus of said liquid developer at said opening, said fluid resistant member keeping said convex meniscus slightly spaced from said latent electrostatic image carrier in the absence of a latent electrostatic image opposing said opening, so that said liquid toner projects from said convex meniscus only to said latent electrostatic image formed on said latent electrostatic image carrier, whereby said latent electrostatic image is developed into a visible image;

means for transferring said visible image from said latent electrostatic image carrier to a recording member; and means for erasing said latent electrostatic image and said visible image from said latent electrostatic image carrier.

* * * * *